US005359871A

United States Patent [19]

Morello

[11] Patent Number: 5,359,871

[45] Date of Patent: Nov. 1, 1994

[54] MICROPROCESSOR CONTROLLED APPARATUS AND METHOD FOR FORMING METAL BUILDING PANELS

[75] Inventor: Frederick Morello, Johnstown, Pa.

[73] Assignee: M.I.C. Industries, Inc., Reston, Va.

[21] Appl. No.: 54,135

[22] Filed: Apr. 30, 1993

Related U.S. Application Data

[63] Continuation-in-part of Ser. No. 872,005, Apr. 22, 1992, Pat. No. 5,249,445.

[51] Int. Cl.[5] ..... B21D 13/04; B21D 53/00

[52] U.S. Cl. ..... 72/7; 72/9; 72/168; 72/177

[58] Field of Search ..... 72/9.7, 12, 14, 17, 72/168, 177, 173

[56] References Cited

U.S. PATENT DOCUMENTS

| | | | |
|---|---|---|---|
| 2,986,193 | 5/1961 | Howell | 72/177 |
| 3,150,707 | 9/1964 | Howell | 72/177 |
| 3,452,568 | 7/1969 | Vihl | 72/177 |
| 3,670,553 | 6/1972 | Knudson | 72/307 |
| 3,831,421 | 8/1974 | Koger, Jr. et al. | 72/307 |
| 3,842,647 | 10/1974 | Knudson | 72/177 |
| 3,875,642 | 4/1975 | Knudson | 29/243.5 |
| 3,902,288 | 9/1975 | Knudson | 52/86 |
| 3,955,389 | 5/1976 | Foster | 72/9 |
| 3,967,430 | 7/1976 | Knudson | 52/745 |
| 4,039,063 | 8/1977 | Knudson | 72/169 |
| 4,047,411 | 9/1977 | Foster | 72/17 |
| 4,080,815 | 3/1978 | Foster | 72/173 |
| 4,205,544 | 6/1980 | Foster | 72/307 |
| 4,232,540 | 11/1980 | Cain | 72/17 |
| 4,364,253 | 12/1982 | Knudson | 72/187 |
| 4,391,116 | 7/1983 | Yogo | 72/177 |
| 4,470,186 | 9/1984 | Knudson | 29/243.5 |
| 4,505,084 | 3/1985 | Knudson | 52/528 |
| 4,505,143 | 3/1985 | Knudson | 72/181 |
| 5,036,688 | 8/1991 | Gillean | 72/17 |

FOREIGN PATENT DOCUMENTS

| | | | |
|---|---|---|---|
| 2008999 | 6/1979 | United Kingdom | 72/307 |

*Primary Examiner*—Daniel C. Crane
*Attorney, Agent, or Firm*—Rothwell, Figg, Ernst & Kurz

[57] ABSTRACT

A microprocessor controlled apparatus and method for processing sheet material into building panels for assembly into buildings. The sheet material is formed into a panel having a flat bottom and sides while the length of the formed panel is monitored to control operation of the forming device. The panel is then fed into a curve-forming device which crimps at least a portion of the panel so that it is arched or curved. The curvature of the output panel is monitored to control the location of adjustable crimper rollers disposed in the curve-forming device to provide the portion of the panel with an accurate preselected curvature. The length of the curved portion of the panel is monitored when producing panels having both straight and curved portions, and the crimper rollers automatically reset to form portions with a different radius of curvature. Predetermined panel designs can be stored in a database and the microprocessor can control the apparatus to automatically produce such panel designs upon the input of appropriate data.

15 Claims, 8 Drawing Sheets

MICROPROCESSOR CONTROLLED APPARATUS AND METHOD FOR FORMING METAL BUILDING PANELS

CROSS-REFERENCE TO RELATED APPLICATION

This application is a continuation-in-part of Ser. No. 07/872,005, filed Apr. 22, 1992, now U.S. Pat. No. 5,249,445, issued on Oct. 5, 1993.

BACKGROUND OF THE INVENTION

1. Field of the Invention

This invention relates to improvements in apparatus and methods for constructing metal building panels with arched portions from flat sheet material. The panels are connected to form a self-supporting building with seamed joints between adjacent panels.

2. Background and Prior Art

It is known in the prior art to make metal buildings from adjacent formed metal building panels which are arched or curved, assembled side-by-side and seamed together. See for example, Knudson U.S. Pat. No. 3,902,288 (1975) for a showing of such buildings in which the roof panels are completely curved or arched and extend to the foundation. In such buildings the roof panels continue as the side walls of the building and the basic building construction is in the shape of a continuous arch or semi-circle when viewed from the end. A machine for making the metal panels for such building in which the formed panels are corrugated not only on the side edges of the box, but also on the bottom to create the curvature, is shown in Knudson U.S. Pat. No. 3,842,647 (1974). A method of building the building by adjacent panels which are seamed together is disclosed in Knudson U.S. Pat. No. 3,967,430 (1976). A seamer for forming the seams between the adjacent panels of the prior Knudson patents is shown in Knudson U.S. Pat. No. 3,875,642 (1975). The prior art represented by the Knudson patents is owned and has been commercialized by M.I.C. Industries, Inc. of Reston, Virginia in its mobile K-Span® machines.

An apparatus and method for forming corrugated building panels using manually adjustable forms are disclosed in Howell U.S. Pat. No. 2,986,193 (1961) and U.S. Pat. No. 3,150,707 (1964).

An arched building construction in which the walls and roof are completely arched has advantages, but also a number of limitations. One limitation is the absence of vertical walls which limits the use of vertical space. Often users of metal buildings want vertical walls both for aesthetic purposes and to allow more use of space near the edges of the buildings. Additionally, known prior art machines had a limitation on the thickness of steel used in forming the metal panels, because of machine limitations. The basic size and strength of such metal buildings is also limited by local wind and live load limitations as established by building codes throughout the nation and the world. As these building code standards become more conservative, a builder is effectively limited to only certain size buildings. The complete arched building must be limited in size in order to prevent overloading such as could occur from extensive wind loads produced by hurricanes. However, when the total roof height is reduced to approximately one-fifth of the total building width, hurricane force winds do not affect the building as much because of reduced frontal area. Thus, there is a need in the art for a metal building formed of continuous panels which is not completely arched but has straight vertical walls while utilizing the economy of the seamed panel construction of the prior art. Such vertical wall buildings would satisfy a need in the art for space, economy, usefulness and strength.

In addition to the prior art discussed above, Knudson U.S. Pat. No. 4,039,063 (1977) discloses a run-out apparatus and method for handling formed panels to produce arched metal buildings. As shown in the patent, run-out tables can be positioned to collect the curved panels. Additional patents exist in the art for forming and assembling relatively wide panels for arched metal buildings, see Knudson U.S. Pat. Nos. 4,364,263 (1982) 4,505,143 (1985), 4,505,084 (1985) and the seamer therefor in Knudson U.S. Pat. No. 4,470,183 (1984). These patents are owned by and commercialized in M.I.C.'s Super Span® mobile metal forming machines. In the prior art the radius of the arch could only be adjusted by manual means. Furthermore, the radius of the arch could only be adjusted to a desired curvature when there was no material in the machine. The procedure for radius adjustment included setting dials to a reference number to form a predetermined length of metal then forming the metal and comparing it to a radius gauge that must be made from a plywood template or a similar radius measuring device. If after inserting a piece of metal in the machine and curving it, the radius is incorrect, the operator must dial in a new set of numbers and rely on experience and rules of thumb to help him achieve the proper radius. In order to achieve the proper curvature for arched panels, up to 500 pounds or more of metal may be wasted by bending them to the wrong curvature, depending on how skilled the machine operator is. Thus, there is need in the art to provide for automatically and controllably adjusting the radius of curvature and to be able to accomplish that with material in the machine, so that no material is wasted in reaching the desired curvature.

Another drawback in the prior art is that the dials set to control the radius of the panel independently operate on the top side of the panel or the bottom side. Failure to adjust the two dials properly will cause the curved panel to distort and produce panels which are unacceptable for building use and must be scrapped. Distortion is sometimes termed "corkscrewing." Thus, there is need in the art to allow automatic and continuous adjustment of the curvature of the panels by a semi-skilled operator.

Another deficiency in the prior art arched panel forming machines is that they do not produce straight sections and curved sections together on the same panel. Furthermore, straight panels formed separately and used as vertical wall building panels are weak because they are not crimped. In other words, with the existing technology, crimping just the side walls of the panels cannot be accomplished although there is a need in the art to provide for a crimping of the side walls of straight panels used as vertical building walls.

Furthermore, the prior known machines for producing arched metal building panels have main crimping rollers which when being adjusted separate from each other causing diminished contact area of the gears resulting in significant premature gear wear. Also, when the crimping rolls of the prior art become separated, it is very difficult to re-engage the gears without physically guiding them into position which requires the machine operator to adjust the machine with moving machine parts, which is unsafe. Furthermore, when the main rolls are separated and the gear teeth are so far out of mesh, the gear backlash is severe, causing the main crimpers to turn out of time with each other and results in unacceptable finished panels. There is a need in the art for an improved drive train of the main crimping rolls which eliminates the above-mentioned problems and allows for an extremely smooth, trouble-free automatic crimping operation.

In the prior art, the operation of the machine was manual and the hydraulic system was adequate, however, it is desirable to allow simultaneous use of components and automatic and continuous adjustment of the crimping operation while allowing the hydraulic control of the panel former, shear blade and other controls. Thus, there is a need in the art for automatic controls from a control panel so that a semi-skilled operator can automatically control the forming machine to produce panels of any desired curvature including portions which are straight and not curved.

SUMMARY OF THE INVENTION

This invention provides a microprocessor controlled apparatus and method for forming panels to make metal buildings in which a portion of the panels are curved and the curvature is automatically controlled. The apparatus and method also make panels which are strengthened by crimping and which panels may have a straight as well as a curved portion so that the panels can be used to construct a building with an arched roof and vertical walls. Automatic control is through hydraulics and a microprocessor which monitors forming of the panels. The curvature of an arched portion of the panel is controlled by the extent of crimping of the bottom of the panel and the extent of crimping is determined by the automatically controlled spacing of main crimping rolls. Moreover, the controls are operable during forming of the panels and with the panels in the crimping rolls. Automatic positioning of the crimping rolls is accomplished without premature wear on the roll drive gears or undue backlash, i.e., it is accomplished with an extremely smooth, trouble-free drive train. The hydraulics of the system together with the electrical control features allow the machine to be operated by a semi-skilled worker without a great deal of experience.

DETAILED DESCRIPTION OF THE PREFERRED EMBODIMENTS

Figure 1:
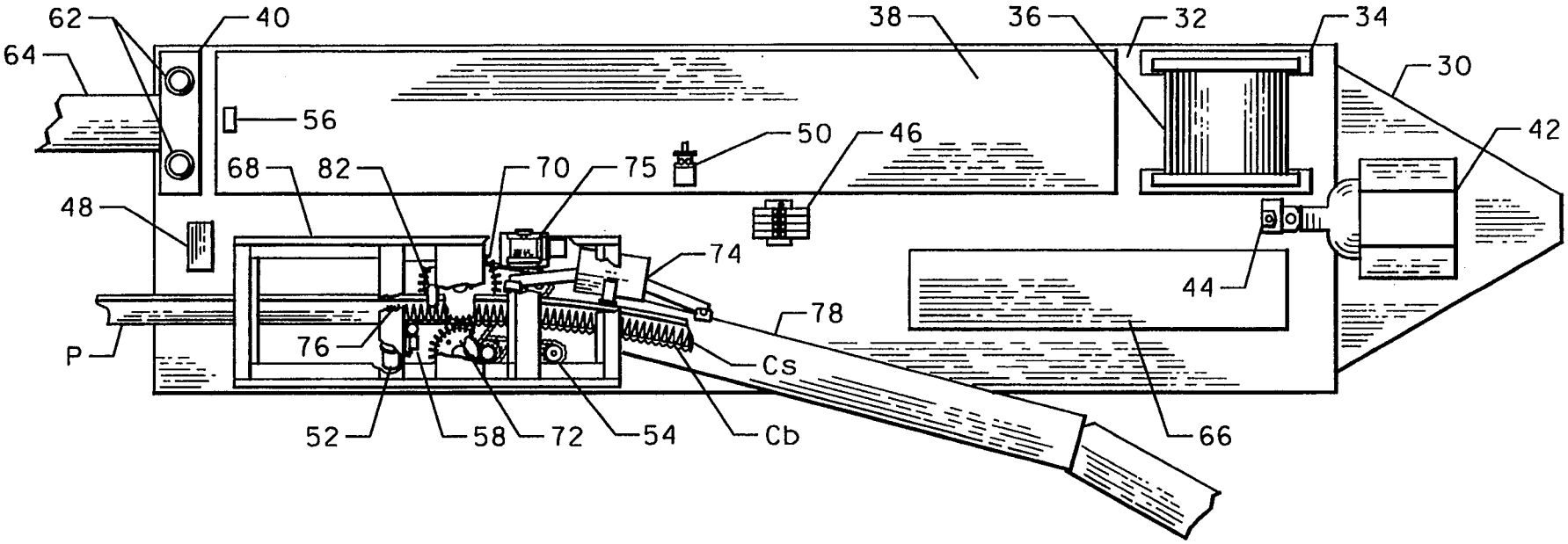
FIG. 1 is a top plan view of the apparatus of the present invention illustrating the general arrangement of the component parts and with some portions broken away and other positions shown only schematically for clarity.
Figure 2:
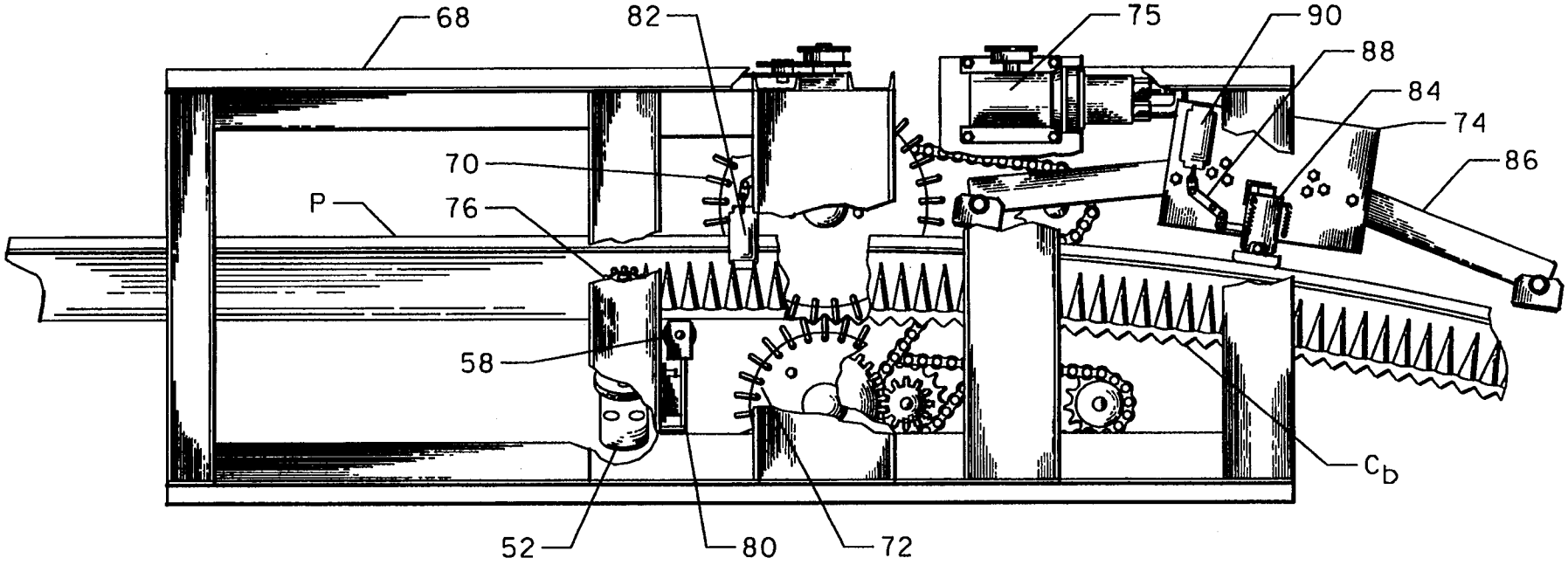
FIG. 2 is a partial top plan view of the machine of this invention with portions broken away for illustrating the main crimping rolls and the controls thereof.
Figure 4:
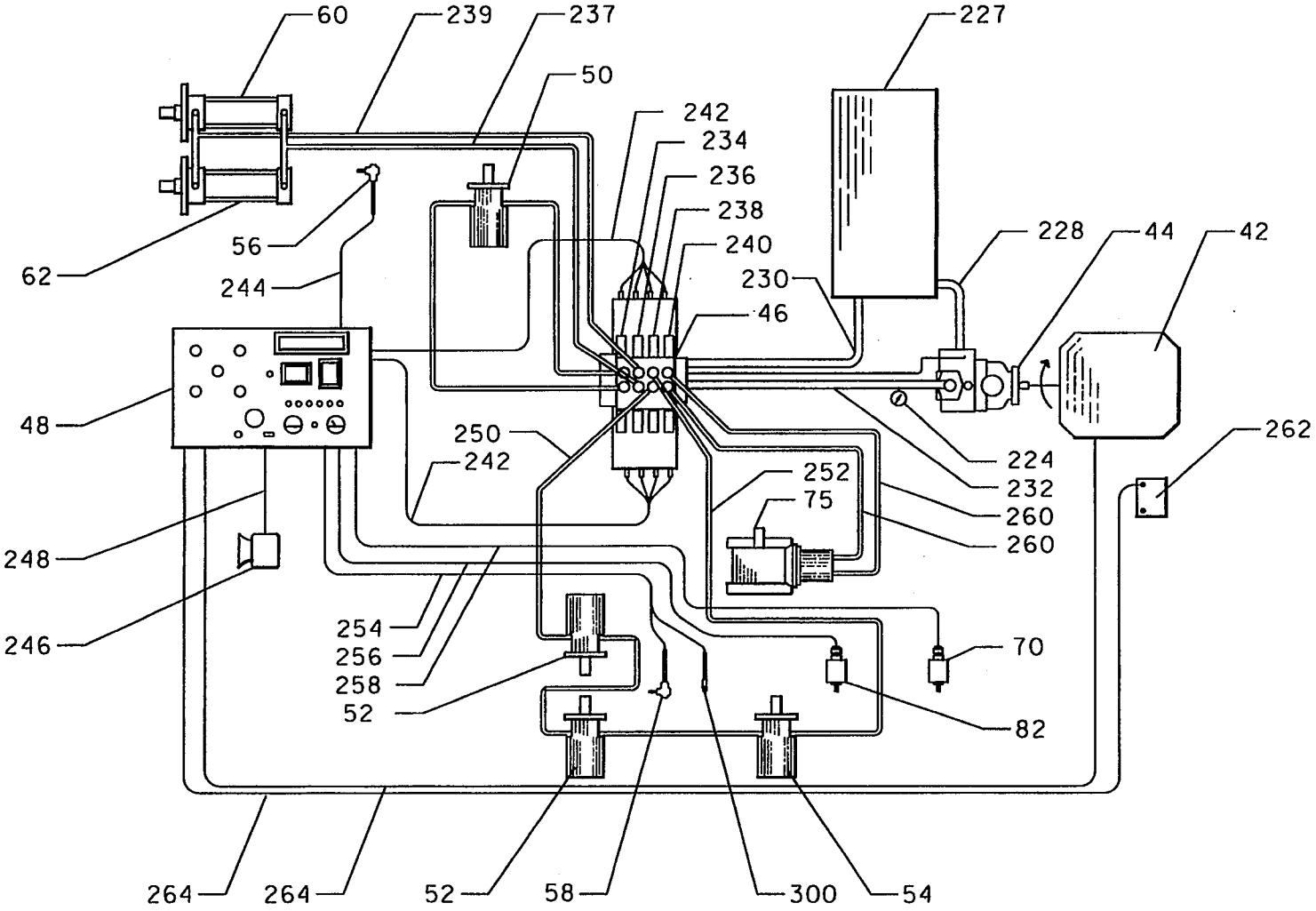
FIG. 4 is a schematic diagram illustrating the connections from the hydraulic and electrical systems for the automatic control of the entire apparatus.

FIGS. 1 and 2 show the general arrangement of the apparatus for producing the metal building panels used to construct buildings in accordance with the present invention. The components of the apparatus are described at length in the parent application referenced above and will be discussed herein only in connection with the microprocessor control features of the present invention. FIG. 4 shows the hydraulic and electrical systems for automatically controlling the present invention which systems are discussed in detail in the parent application.

As seen in FIG. 1, the sheet material is automatically fed from roll 36 into roll forming machine 38 which forms the sheet material into a desired configuration. This roll forming machine or panel-former 38 is known in the art as is the shape of the panels leaving the machine. A hydraulically operated shear 40 cuts the formed panel to a measured desired length.

The formed panel P is then fed into the crimping and curving assembly or curve-former 68 which first crimps the sides of the panel and then crimps the bottom thereof to form an arched building panel as is known in the art. The crimping is performed by respective pairs of crimper rollers which are adjustable to form specific panel sizes and shapes. Contrary to the prior art method of manually setting the crimpers and experimenting to obtain the desired panel form discussed above, the present invention utilizes a central control unit including a microprocessor to automatically control the panel forming assembly and the curver assembly based on data input by the operator.

Figure 3:
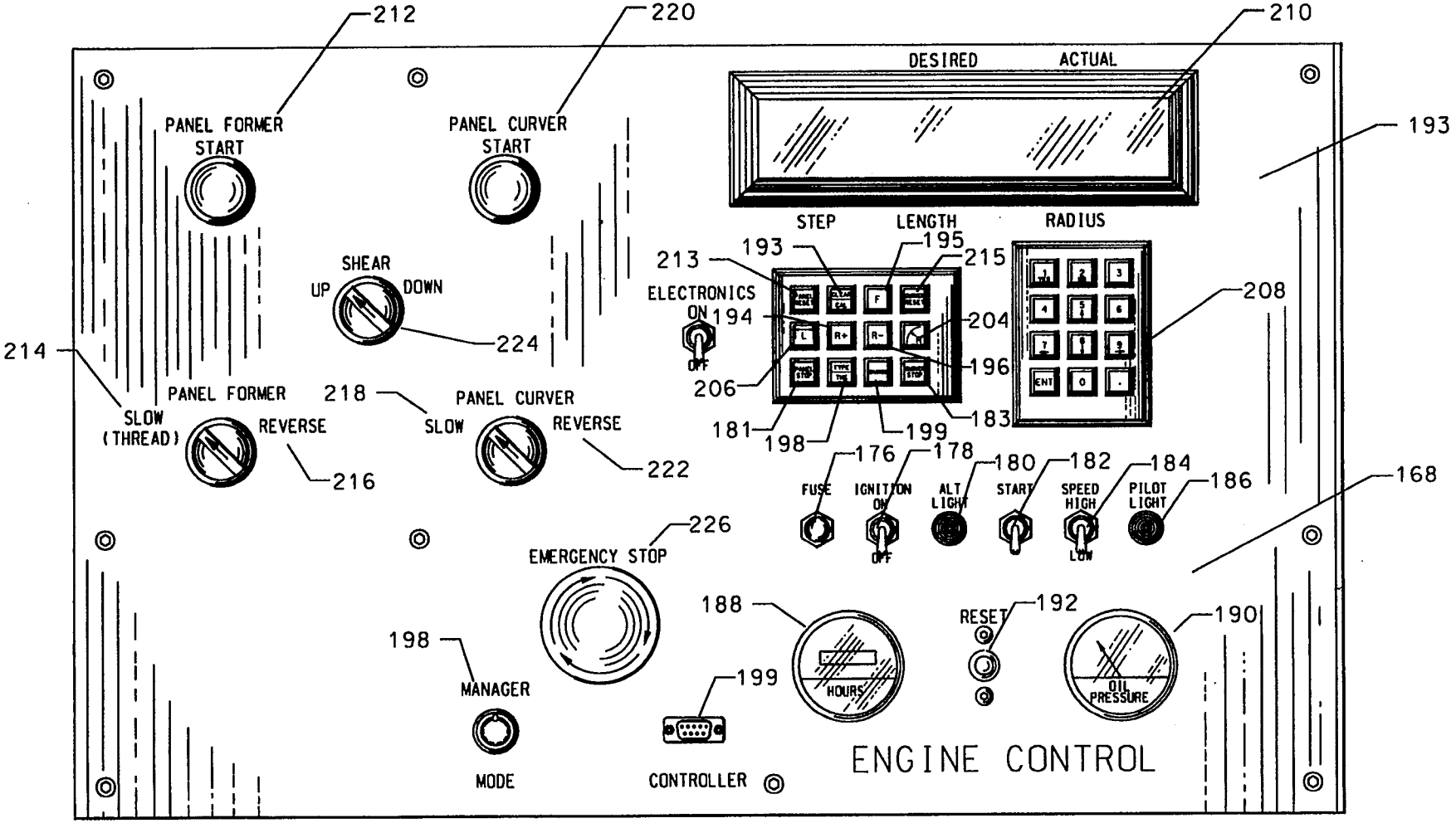
FIG. 3 is an end elevation view illustrating the control panel for control of the machine from one spot by a semi-skilled operator.

This data is input through the control panel shown, in FIG. 3, which panel is connected to a microprocessor that receives digital signals from a plurality of sensing means to control various aspects of the apparatus as will be described below. The data entered by the operator is compared to a database that has been previously established and the microprocessor then sets the apparatus to the appropriate parameters for forming the desired building panels. As discussed above and in the parent application, the apparatus is capable of producing panels arched over their entire length and panels having both straight and arched portions.

The microprocessor 301 is in communication with a database 303 in which is stored information concerning parameters such as metal thickness, crimper positions for various radius curves, special building codes, etc. The unit is accessed through security key 198 to initially program the apparatus; this key places the apparatus in to the "manager mode" which is used to calibrate or change the data input into the unit at any time as discussed below. Calibration of the system will now be discussed.

The known data for different ranges of metal thickness is entered and stored in the database by inputting the maximum radius values and lengths allowed for a given metal thickness being entered. It is also possible to input the minimum radius for each metal thickness. This is the main data which is used by the system for automatically processing the panels. For example, with a metal thickness of 0.020 inches, the maximum radius of a building using this sheet metal would be 35 feet. Accordingly, the microprocessor will not allow a panel 0.020 inches thick to be formed into a panel with a radius of curvature greater than 35 feet. Appropriate data defining a range of tolerances, i.e. allowed error, for various measured values, e.g. length and radius, is also stored.

A number of radius samples along with the corresponding crimper positions for such samples are also stored in the database. This data is in the form of a table of corresponding radius and crimper position values. The number of radius samples entered is at a minimum two and preferably more than two, e.g. ten. The system sorts the entered pairs from largest to smallest. An operator defined radius is input into the system and compared to the previously entered radius samples and interpolation is used to obtain the crimper position corresponding to the operator defined radius. The position of the crimpers 70, 72 which permits the formed panel to pass therethrough without being crimped is also stored to allow panels which are straight or have a straight portion to be produced.

The present system is preferably used with a database method of converting readings of the various sensing means, e.g. panel distance or the measured crimper position, into lengths and radii. This information can be programmed into the system before initial use, and the user can select the database approach or an alternative formula approach to determining crimper position from the sensor readings. The formula approach calculates the crimper position based on a selected radius value and will be discussed below. The data concerning the respective speeds of the panel-former 38 and the curve-former 68, i.e the slow speed used for the beginning and ending of the respective cycles and the faster normal speed used during operation, is also entered into the database. The point at which the travel of the panel switches from one speed to the other in the former 38 and the curver 68 can also be preset within a number of feet or electronic pulses from length sensor 56 and curve length sensor 58, respectively. This data sets the hydraulic actuators which drive the sections 38, 68 at proper speeds in both forward and reverse. This data can be accessed and changed by the operator when the system is in its "manager mode" engaged by key 198.

Data indicating the distance from the various sensing means to reference points for calculating when the formed panel corresponds to the selected length, radius of curvature, length of curved portion, etc. is also input, as will be discussed below. For example, the distance from the curve length measuring encoder 58 to the center of the crimping rollers 72 is used to electronically set a distance from the measuring encoder to the actual crimping position of the crimper rollers. Similar calibration data regarding the encoder 56 which measures the length of panel exiting roll forming section 38 is used to accurately control the hydraulic drive for section 38 to produce the selected length of panel P. Data concerning the initial position of the encoder 82, which measures the distance between crimper rollers 70, 72, and encoder 74, which measures the curvature of the panel exiting curving section 68, is also provided.

A plurality of sensing means emits electronic pulses which correspond to panel parameters, e.g. the length of panel formed during the time the sensor emits 3000 pulses. The data defining the relationship between the number of electronic pulses generated by each sensor or encoder and the length or radius of the panels is stored in the microprocessor. The panel former sensing means 56 can be calibrated either manually or automatically. The system can be accessed when in the "manager mode" and the conversion factor, i.e. the ratio of pulses to length or radius in feet, can be directly input. It is also possible to access a stored program in which the microprocessor forms a panel with a length according to three thousand pulses, the user then measures the length of the panel and enters it in feet to calibrate the panel former sensing means 56.

The calibration of the curve former length sensing means 58, which includes encoder 80 for measuring the length of formed panel fed into the curve former section, is similar to the panel former sensing means 56. The user depresses the calibrate-radius length buttons and inserts the metal panel into the curver. The curver is then run and the known panel length is entered into the system which calculates the conversion factor. The calibration can be done manually also by simply entering the pulse/feet ratio directly as with the panel former length sensing means 56.

The calibration of the crimpers and the radius of curvature they produce is performed as follows. Normally, the system will position the crimper rolls 70, 72 according to the database or formula method as described above. That is, the proper crimper position for a selected radius will be calculated by the microprocessor from the crimper/radius data stored in tables in the database or, alternatively, will be calculated by the microprocessor according to a preprogrammed formula. The following formula can be used: crimper position=crimper position for flat panel+(conversion constant/selected radius). The conversion constant is a number which is calculated for each machine that will enable the formula to yield the correct crimper position from a selected radius.

When the radius is to be calibrated, the user presses the clear-calibrate key 193 and then the R button 204. The system first checks whether the actual position of the rollers is the same as called for by the preset. If not, the system asks the user if he wants the crimpers moved. An affirmative response causes the system to automatically move the crimpers to their proper position.

When the crimpers are in position, the user is asked to curve a sample piece using the curver start button 220 and curver stop button 183. The user is then asked to place the radius sensing means 74 against the curved panel and press enter when set. If the measured radius is within pre-programmed tolerances, the system indicates that the radius is calibrated. If not, the percentage error is displayed and the user is asked if he wants to recalibrate the radius adjustment.

The user can then calibrate the curver either manually or by using an auto-adjust feature. The user can manually set or check the calibration of the system by using the "manager mode" (which is accessed by authorized personnel) to enter the corrected value. The corrected radius/crimper position will be stored and used by the machine until the user changes the radius. Whenever the user changes a radius, the system uses either the formula method or database method to compute the corresponding position of the crimpers. With the manual calibration method, the user calibrates the crimper positions using the R+ and R− buttons. The system can be set when in the "manager mode" to display the "old" and "adjusted" positions of the rollers while the auto-adjust is being performed so that the user can view the changes.

The system can also automatically check the calibration of the crimpers. With this auto-adjust feature, the system attempts to correct the error in crimper position by an amount proportional to the measured error in radius. This is done by using an auto-adjust constant calculated by taking the average value of the ratio of: crimper roller position (as measured by encoder 82)/radius of curvature (as measured by sensing means 74) for a wide variety of crimper position-radius readings. The system then uses the constant to correct the roller positions. As such, this method could be used to convert a selected radius to the proper crimper position should the previously discussed database and formula methods prove inaccurate.

If the display is enabled when the system is programmed in the "manager mode" then the "old" and "adjusted" values of the crimper roller position will be shown while the adjustment is made.

An offset for the crimper rollers 70, 72 is also entered to provide for a closing motion whenever the rollers are adjusted. The rollers are automatically opened past their desired position by a set amount and are then moved back to the position in a closing motion. This insures that the crimper rollers will always rest against the pressure part of the acme type thread (which has gaps between threads) and will not rest against an air gap formed between the threads. The amount that the crimpers are moved past the desired point is pre-programmed as is the speed at which the crimpers move into proper position.

As will be discussed below, it is also possible to store data relating to any of several "common" building types, i.e., special building codes can be stored so that an operator simply chooses the particular code and the system forms the panels into the shape corresponding to that type of building. FIGS. 6A–6H depict several building types which include panels having various combinations of straight vertical portions, straight slanted portions, radius corners, and different radius arched portions. By entering the particular code, the microprocessor accesses the data in the database, sets the former and curver sections appropriately, and then controls their operation to produce such panels.

Figure 5:
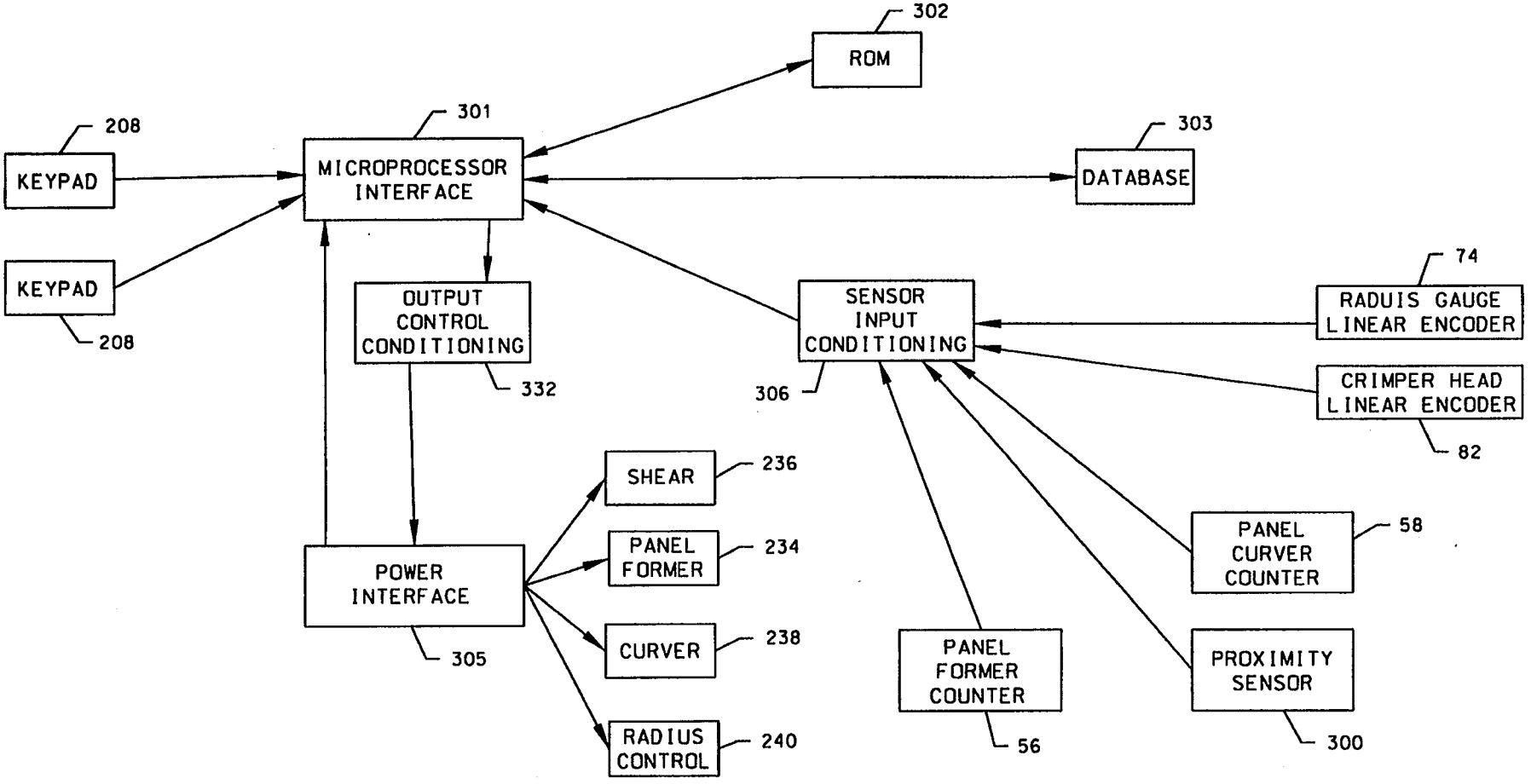
FIG. 5 is a schematic block diagram of the microprocessor control circuit of the present invention.
Figure 6A:
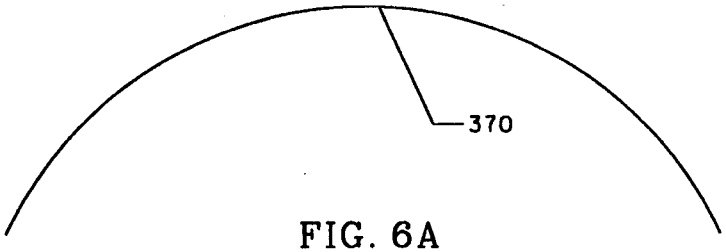
FIG. 6A–6H show several of the many building panel configurations which can be produced according to the present invention.
Figure 6B:
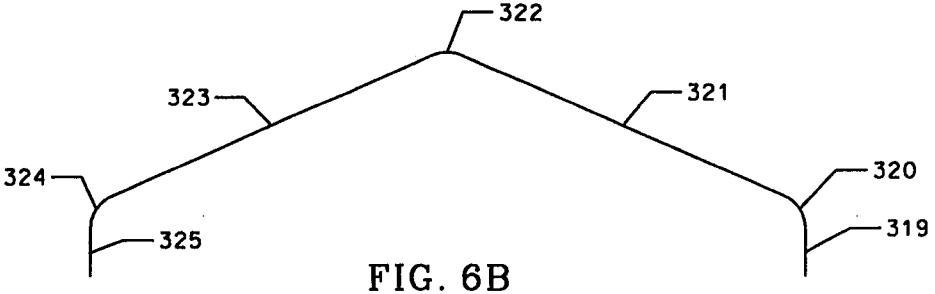
Figure 6C:
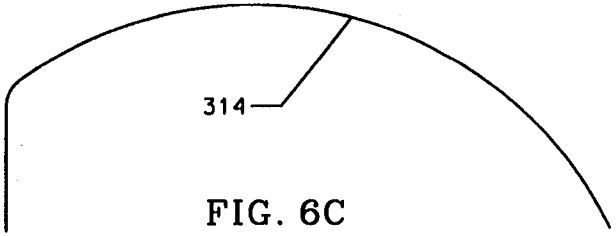
Figure 6D:
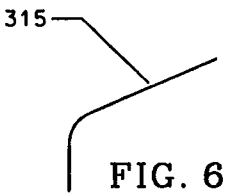
Figure 6E:
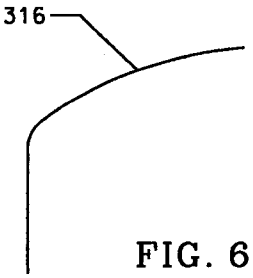
Figure 6F:
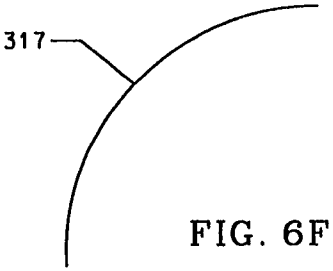
Figure 6G:
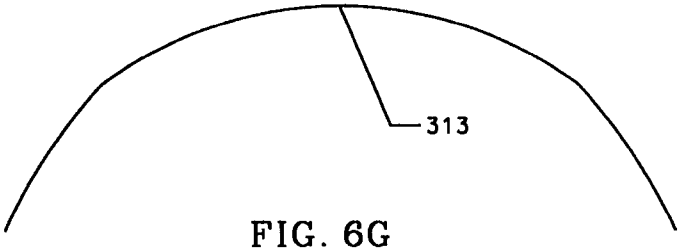
Figure 6H:
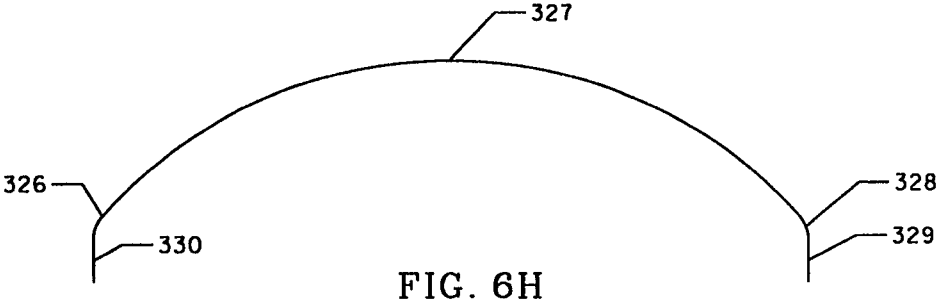

FIG. 5 shows a schematic diagram of the control system of the present invention. Keypad 208 is connected to a microprocessor 301 for inputting data concerning the forming operation. The microprocessor 301 interfaces with a database 303 which is a ROM (read only memory) chip as is known in the art. The database 303 can be accessed through an RS-232 serial port (not shown) for connection to additional equipment, e.g. a computer. The microprocessor receives electrical signals from sensing means including a plurality of sensors which monitor various parameters as discussed in the parent application. In response to these signals, the microprocessor outputs signals to the actuators 234, 236, 238, 240 through power interface 305. The actuators in turn control the operation of the respective components, i.e., the panel former, curver, etc.

Sensing means 56 is in the form of a rotary encoder which measures the length of panel output from the panel former section 38. Sensing means 58 is in the form of a rotary encoder which measures the length of curved panel by sensing the length of panel run through the side crimper rollers of the curve former section 68. Sensing means 74 is in the form of a linear encoder which measures the radius of curvature of the curved panel exiting the curve former section 68. Sensing means 82 is in the form of a linear encoder or potentiometer which measures the distance between the crimper rollers 70, 72; this distance determines the amount of curvature put in the panel.

Crimper roller 70 is movable by a hydraulic motor as discussed in the above-referenced parent application. Encoder 82 senses the position of crimper 70 and microprocessor 301 determines the resulting radius from this setting of the crimpers. In producing panels which are arched over their entire length, only sensing means 56, 74, and 82 generate signals, while sensing means 58 is used in addition when producing panels having both straight and arched portions.

The electrical signals transmitted from the sensing means to the microprocessor 301 are suitably filtered and conditioned as is known in the art and indicated by 306.

The microprocessor 301 is connected to a power interface 305 which interface controls the hydraulic drive feeds of the panel former section 38, the curve former section 68 and sets the relative position of the crimping rollers 70, 72 to achieve the desired radius of curvature. In response to receiving the sensing means input, output signals from the microprocessor 301 are first processed for pulse width modulation as indicated by block 332 and then sent to the power interface 305 to appropriately control the aforementioned former, curver and crimpers, as will be further described below.

The arched building panels produced by the present invention will be broken into two basic types for purposes of explanation: panels arched over their entire length and panels having both arched and straight portions. When the system is powered up the display screen 210 on the control panel asks the user to press "enter" to start. The user is then asked if he wants to change the current settings. A response of "no" displays the current settings, e.g. metal thickness and length and radius for each step in the curving sequence, one at a time and the user can view and change the settings. After viewing or changing all settings, the user is asked if he wants to use the other settings. An answer of "yes" causes the system to continue.

The forming of a building panel arched over its entire length will now be described. After the user enters the desired values for the settings mentioned above, the system checks the current crimper position through sensing means 82 as described above. If the position does not come within a previously programmed tolerance of the desired value, the system asks the user if he wants the crimpers moved. After the crimpers have been moved to the proper position, the screen returns to its normal condition.

To begin operation the user presses the panel former start button 212 which starts the panel former motor through power interface 305 and panel former actuator 234. The speed is slow at first and then speeds up before slowing again at the end of the cycle. The specific speed as well as the point at which the speed changes is preprogrammed as discussed above. The sensing means 56 emits pulses corresponding to the length of formed panel output from the panel former section 38. The microprocessor cooperates with the power interface to stop the panel former motor drive upon reaching the end of the selected panel length.

The panel former stop button 181 can be used to stop the former in an emergency or if it is desired to stop the former without resetting the length reading on sensing means 56. To start the former again, the panel former start button 212 is pressed. The panel length sensor reading of sensing means 56 is reset upon operation of the hydraulic cutter through button 224 which controls shear actuator 236, or by pressing the panel reset button 213. If it is desired to run additional panels after the former 38 has finished one panel and stopped, the user presses the change button 199 and then the L button 206. The user then inputs the new length and presses the enter key. The panel length sensing means 56 is reset and the process continues as before.

Assuming that the system checks the actual position of the crimpers and such position is within preset tolerances of the selected radius as discussed above, the curve former is ready and the user then feeds the panel into the curve forming section 68 and the panel curver start button 220 is pressed. This starts the crimper motor at fast speed. The curver stop button 183 stops the crimper motor at any time. Upon exiting the curve former 68, the panels are ready to be joined side-by-side and seamed together.

The use of the system to produce special building panels having a combination of curved and straight portions will now be described. Unlike the full length arched panels, the special panels have a length comprised of a plurality of sections or steps which are either straight or curved to a particular radius. It is possible to program a number of special building codes which correspond to predetermined step length/radius data stored in the database to allow the user to select a special panel type which the system will automatically produce. Some specific panel types will be discussed below.

The user enters the special building code using button 198 and keypad 208 when initially operating the system. The display shows the value of the building type on the lower line if it is not building type one (the full arched panel). Next, the display will indicate that a crimper reset is needed and curver reset button 215 needs to be pressed. After pressing 215 the crimpers will be moved into position and the display will direct the user to press the curver start button 220 to start the curving. The curve former runs at a slow speed at the beginning and end of each curving step, and at a faster speed in between. This is unlike the constant radius arched panel which is formed with the curver running at a continuous fast speed.

When the curve former begins operation, the lower line of the display will show the current curving step and will count down to the last step. For example, in forming a panel with five steps, step five will be shown including its length which is counted down to zero. The curve former stops at the end of the step and the crimper rollers are adjusted to the curvature of the next step. After completion of the final step, the system will direct the user to press the curver stop button 183 which cuts off the curve former drive. The display then indicates that crimper reset is needed, and the user presses curver reset button 215 as before to process another panel.

An example will be explained with reference to building type 2 shown in FIG. 11. The first step (step 7) displayed would be panel portion 319 and the length would be shown as ten feet and the radius as zero (for a straight step). The crimpers would then move all of the way apart and the curve former would start with the display counting down the length from ten feet to zero. When the length of step 319 was finished, the crimper rollers would automatically be positioned to correspond to the radius of curvature of the next step, point 320 (step 6). The curve former would then run this step with the length displayed as before.

The crimper rollers would again move to the apart position and the next step (step 5) would be displayed. The curve former would run twenty five feet of panel with the length being counted down as before. The crimper rollers would then reset to correspond to the radius of curvature of the next step, point 322 (step 4). After this, the system would automatically repeat steps 5, 6 and 7 to form the symmetrical other half of the panel, with the crimper positions adjusted before each step. At the end of all steps, the display will direct the user to press the curver stop button, which will display the "crimper reset needed" message to allow a new panel to be started as described above.

While several panel configurations are shown, it will be appreciated that any desired building type, i.e., any combination of straight and arched panel steps or portions, can be programmed into the system.

Figure 7:
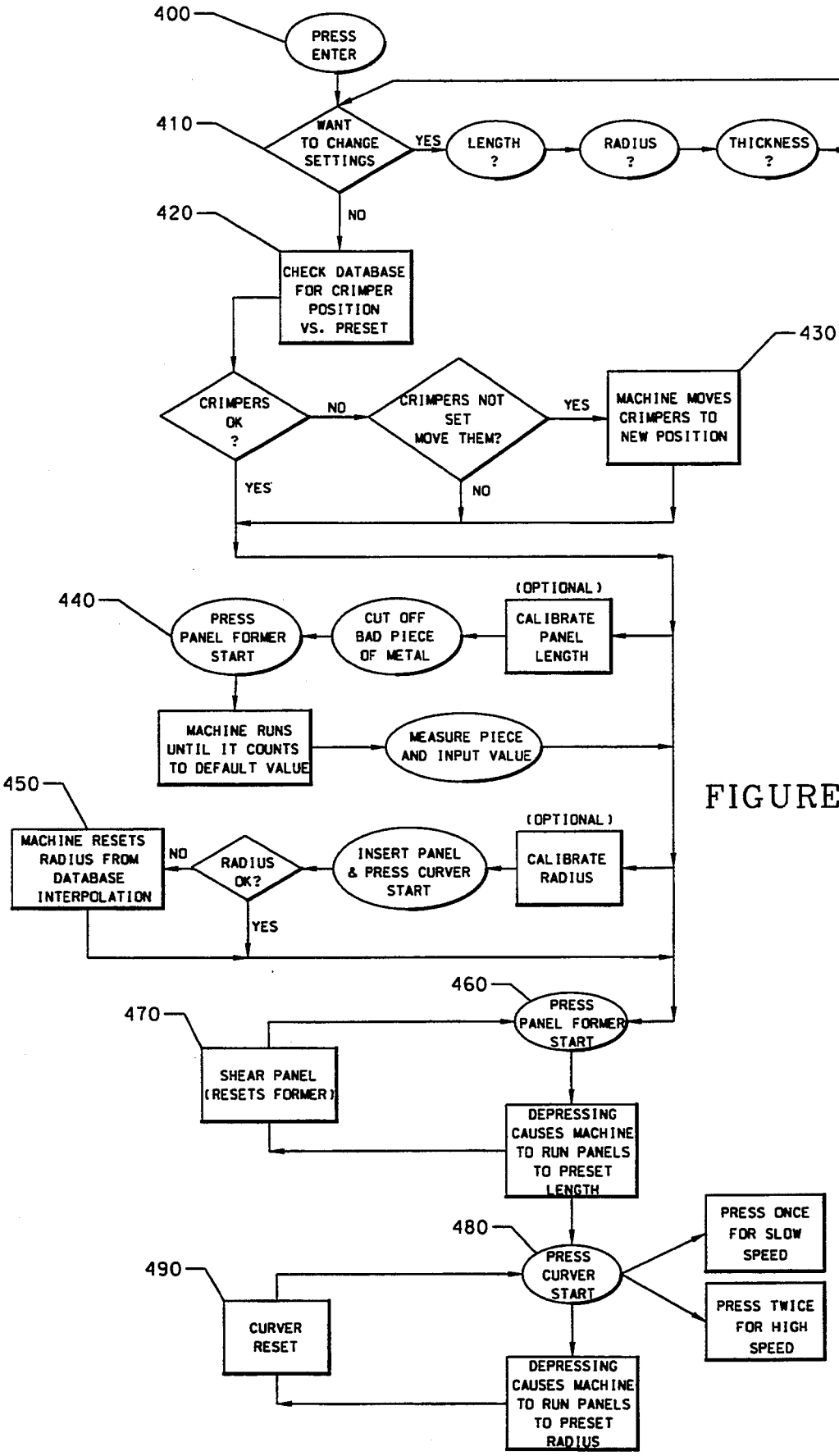
FIG. 7 is a flow chart showing step-by-step production of a fully arched panel.
Figure 8:
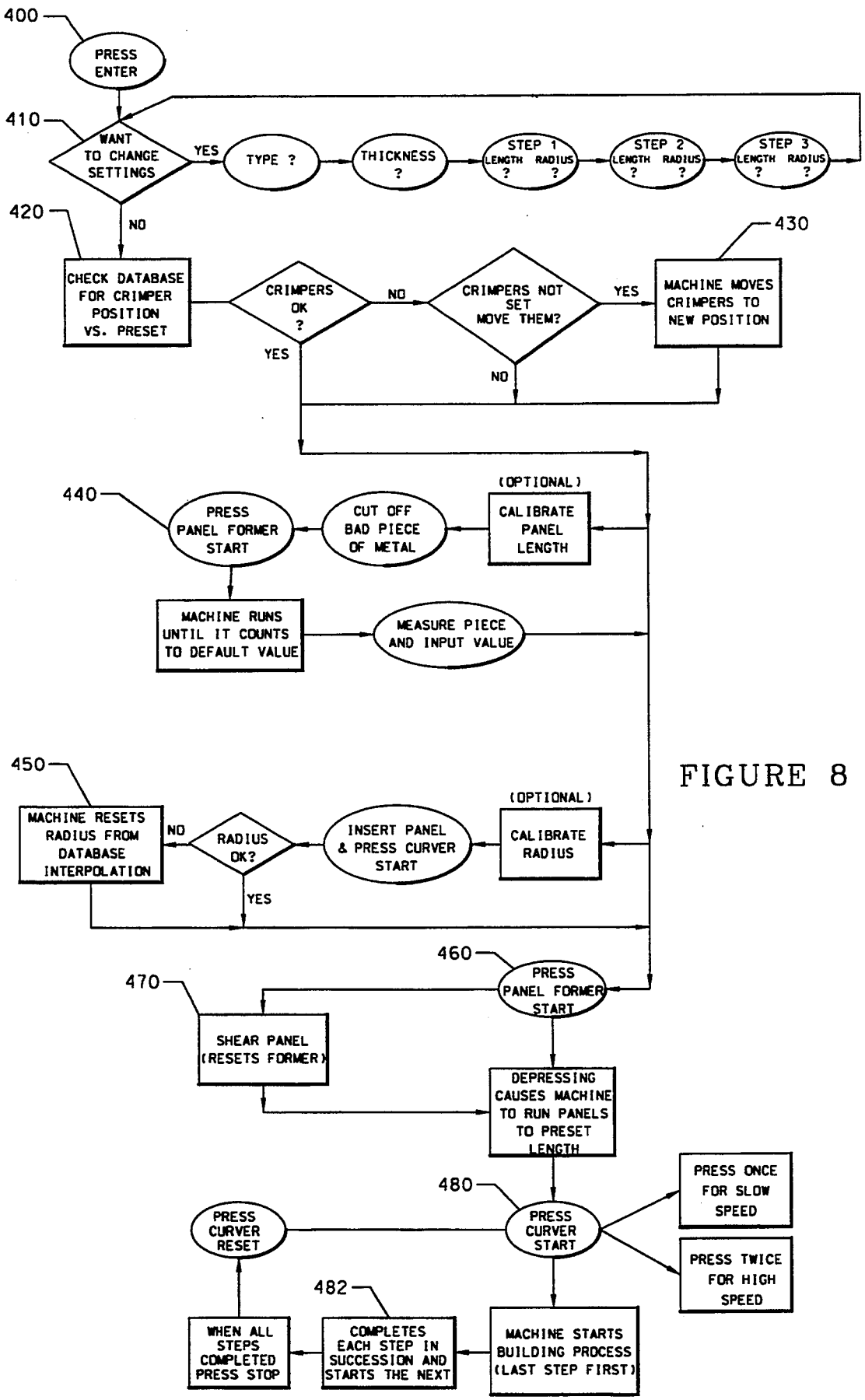
FIG. 8 is a flow chart showing step-by-step production of a panel having both an arched portion and a straight portion.

FIGS. 7 and 8 are flow charts showing step-by-step operation of the arched panel forming apparatus according to the present invention for full length arched panels and special building code panels, respectively. As seen in FIG. 7, the user presses the enter key 400 and the system asks the user if he desires to change the settings, i.e. length, radius and thickness. The settings can be changed as indicated at 410 or left the same after which the apparatus checks the position of the crimpers at 420 to determine if it corresponds to the selected radius as compared with the table of data contained in the database as discussed above. If the position is not correct, the apparatus automatically moves the crimpers to the proper position as shown at 430.

At this point, the user can optionally calibrate the panel length former and/or the panel curver as indicated generally at 440 and 450, respectively, and as described above. With the panel former and curver properly set, the user then presses the former start key 460 to produce panels of the selected length. The hydraulic shearer 470 is then operated to cut the length of panel. FIG. 7 shows the panel former start key 460 being pressed again after actuation of the shearer, before operation of the curver. This corresponds to the procedure in which the user first forms all of the panels and then curves all of the panels. It will be appreciated that the procedure depicted in FIG. 7 is exemplary only and that it is possible for the user to form a panel and then curve that panel while at the same time forming a second panel, thus operating the former and curver at the same time. After forming the panel(s), the user presses the curver start key 480 once for the programmed slow speed and twice for fast speed. The curver reset button 490 is then pressed after the panel has been curved to prepare the curver for the next panel.

FIG. 8 shows the step-by-step production of panels corresponding to the aforementioned special building codes wherein like numerals are used to show steps discussed with reference to FIG. 7. The user can change the settings after pressing the enter key 400 as in FIG. 7, but the settings here include the building type, the metal thickness, and the length and radius for each step of the special building type. After the settings are correct, the apparatus checks the position of the crimpers at 420 as in FIG. 7 and automatically moves them if necessary. The user can then calibrate the panel former and curver at 440 and 450 as discussed above with reference to FIG. 7.

After the former and curver are calibrated, the former start key 460 is pressed to begin forming of the panels. As stated above with respect to FIG. 7, the former can be run to bend all of the panels first which panels are then curved, or the former and curver can be run simultaneously. The curver start key 480 is then pressed and the curver bends each step of the special building type in succession, beginning with the last step, as indicated at 482 and as discussed above. After completion of one special building panel, the user presses the curver reset key 490 to prepare the curver for another panel.

The present invention thus provides an automatic microprocessor controlled apparatus and method for forming building panels used in constructing self-supporting buildings which is easy to use and produces high quality panels without the waste that resulted from the prior art machines.

Although the invention has been described in connection with certain preferred embodiments, it is not limited to them. Modifications within the scope of the following claims will be apparent to those skilled in the art.

What is claimed is:

1. A microprocessor controlled apparatus for automatically producing a building panel from sheet material, at least a portion of the panel being curved, by continuously monitoring processing of the sheet material; the apparatus comprising:

a panel-former for forming the sheet material into a panel having a bottom portion and lateral edge portions;

means for generating a first signal corresponding to a length of panel output from the panel-former;

means for controlling feeding of the sheet material through the panel-former in response to receiving the first signal to produce a selected length of formed panel;

a curve-former including means for curving the formed panel by crimping the bottom portion of the panel;

means for selecting a predetermined curvature to operate the curve-former to receive the formed panel from said panel-former and crimp the bottom portion of the formed panel to produce a panel having at least a portion curved according to said preselected curvature;

means for generating a second signal corresponding to the curvature of the panel that will be output from the curve-former; and a microprocessor for controlling the panel-former in response to said first signal to produce a selected length of formed panel and for controlling the curve-former in response to said second signal so that a panel is output with at least a portion curved according to the preselected curvature.

2. The apparatus of claim 1, wherein the means for generating the first signal includes a rotary encoder for determining the length of panel output from the panel-former and generating said first signal corresponding to such length.

3. The apparatus of claim 1, wherein the means for controlling the feeding of the sheet material through the panel-former station includes the microprocessor which receives said first signal and in response controls the operation of means for feeding the sheet material into the panel-former.

4. The apparatus of claim 1, wherein the means for selecting a predetermined curvature includes a keypad for inputting data regarding a desired curvature.

5. The apparatus of claim 4, wherein the selecting means is for transmitting the curvature data to a microprocessor, which curvature data is compared to data stored in the microprocessor for determining the corresponding position of crimper rollers which will form at least a portion of the panel to have the selected radius of curvature.

6. The apparatus of claim 5, wherein the means for controlling the curve-former includes the microprocessor which operates the curve-former in response to the comparison of said respective data to process the formed panel so that a panel is output with at least a portion curved according to the preselected curvature.

7. The apparatus of claim 1, wherein the means for generating the second signal includes an encoder for measuring the curvature of a portion of the formed panel exiting the curve-former and generating said second signal corresponding to the measured curvature.

8. The apparatus of claim 7, wherein the means for controlling the curve-former includes the microprocessor which receives the second signal and in response controls the operation of the curve-former.

9. The apparatus of claim 8, wherein the means for controlling the curving of the formed panel includes the microprocessor which controls crimper rollers in response to the second signal so that the rollers form a panel having at least a portion curved according to the preselected curvature.

10. The apparatus of claim 9, wherein the means for controlling the curving of the formed panel includes an encoder for measuring a relative position of the rollers and transmitting a third signal indicating the position to the microprocessor to facilitate adjustment of the rollers in response to the second and third signals.

11. An apparatus for automatically forming a building panel from sheet material, the panel having at least one portion curved according to a preselected radius of curvature and at least one straight portion; the apparatus comprising:

means for forming the sheet material into a panel having sides and a flat bottom;

means for measuring the length of sheet material that has been formed into said panel and transmitting a first signal corresponding to the measured length;

means responsive to said first signal for controlling the panel forming means to produce a panel of selected length;

means for curving a portion of the formed panel output from the panel-forming means by crimping the bottom portion thereof so that a portion of the panel is curved according to said selected radius of curvature;

means for measuring both the length of the curved portion and the radius of curvature of the curved portion and transmitting second and third signals corresponding to the measured length and curvature; and means responsive to said second and third signals for controlling the amount of crimping placed in the bottom portion of the panel by the curving means so that the curved portion of the panel corresponds to preselected values of said length and curvature, and so that another portion of the panel passes through the curving means without the bottom portion thereof being crimped to produce a building panel having at least one curved portion and at least one straight portion.

12. A method for automatically producing building panels from sheet material, the panels having at least a portion which is selectively curved; the method comprising the steps of:

selecting a desired radius of curvature and length for the portion of the panel which will be curved;

verifying the position of a crimping means for crimping the bottom portion of the panel to ensure that the crimping means will produce the desired radius of curvature in the panel and, if the position of the crimping means will not produce the correct radius, moving the crimping means to the proper position;

feeding sheet material through a panel-forming device to form a panel having a bottom portion and sides;

measuring the length of the panel as it exits the panel-forming device and sending a first signal corresponding to the measured length to a central control unit for controlling feeding of the sheet material to the panel-forming device in response to said first signal;

feeding the formed panel to the crimping means to selectively curve the bottom portion of the panel according to the preselected radius of curvature, wherein the curvature of the panel portion as it exits the curve-forming device corresponds to the selected radius of curvature; and removing the panel at least a portion of which is selectively curved from the curve-forming device.

13. The method of claim 12, wherein the step of feeding the panel to the curve-forming device curves the entire length of the panel.

14. An apparatus for forming panels which are curved over at least a portion of their length, the apparatus comprising:

means for forming sheet material into a panel having a bottom portion;

means for crimping the bottom portion of the formed panel to curve the panel to a desired radius of curvature;

memory means containing data relating to various radii of curvature and corresponding crimping means positions;

means for selecting a radius of curvature which the formed panel will be curved to by the crimping means; and means for automatically positioning the crimping means in proper position so as to curve the formed panel to the selected radius of curvature by:

(i.) determining the actual position of the crimping means;

(ii.) comparing the actual position of the crimping means to the data in the memory means relating to various radii of curvature and corresponding crimping means positions to determine if the actual position of the crimping means will produce the selected radius of curvature; and (iii.) moving the crimping means to its proper position if the actual position thereof does not correspond to the position contained in the memory means;

whereby a user can select a radius of curvature and the apparatus will automatically position the crimping means in its proper position such that a formed panel can be fed into the crimping means and the bottom portion of at least a portion of the length of the panel will be crimped to produce a panel which is curved to the desired configuration.

15. An apparatus for automatically producing building panels having a predetermined configuration and including at least one curved panel portion and at least one straight panel portion, the apparatus comprising:

memory means for storing data relating to predetermined panel configurations which include at least one straight panel portion and one curved panel portion, the memory means containing data relating to a length of the straight portion, and a length and radius of curvature of the curved portion;

a microprocessor in communication with the memory means;

input means for selecting one of the predetermined panel configurations to be automatically produced by the apparatus;

panel-forming means for forming sheet material into building panels having a bottom portion and side walls, the panel-forming means being controlled by the microprocessor to form the sheet material into a panel having a desired length; and crimping means for crimping a portion of the bottom of the formed panel in order to curve a portion of the length of the panel to a desired radius of curvature, the crimping means being controlled by the microprocessor and positioned to crimp the portion of the bottom of the formed panel so as to correspond to the at least one curved portion of the selected predetermined panel configuration, and said crimping means being controlled by the microprocessor and positioned to leave uncurved a portion of the formed panel so as to correspond to the at least one straight portion of the selected predetermined panel configuration;

whereby a user can use the input means to select a predetermined panel configuration having at least one straight portion and at least one curved portion and the apparatus will automatically produce a building panel having said configuration.

* * * * *